US009899171B2

(12) United States Patent
Aurich et al.

(10) Patent No.: US 9,899,171 B2
(45) Date of Patent: Feb. 20, 2018

(54) THERMAL SAFETY DEVICE

(75) Inventors: Joachim Aurich, Heide (DE); Ulf Zum Felde, Heide (DE); Bernd Krueger, Heide (DE); Laurent Mex, Heide (DE); Wolfgang Werner, Heide (DE)

(73) Assignee: VISHAY BCcomponents BEYSCHLAG GmbH, Heide (DE)

( * ) Notice: Subject to any disclaimer, the term of this patent is extended or adjusted under 35 U.S.C. 154(b) by 587 days.

(21) Appl. No.: 13/811,700

(22) PCT Filed: Jul. 26, 2011

(86) PCT No.: PCT/EP2011/062793
§ 371 (c)(1),
(2), (4) Date: May 23, 2013

(87) PCT Pub. No.: WO2012/016882
PCT Pub. Date: Feb. 9, 2012

(65) Prior Publication Data

US 2013/0234822 A1 Sep. 12, 2013

(30) Foreign Application Priority Data

Jul. 26, 2010 (DE) ..... 10 2010 038 401

(51) Int. Cl.
*H01H 37/32* (2006.01)
*B22D 41/015* (2006.01)
(Continued)

(52) U.S. Cl.
CPC ..... *H01H 37/32* (2013.01); *B22D 41/015* (2013.01); *H01H 37/761* (2013.01);
(Continued)

(58) Field of Classification Search
CPC ..... H01H 37/32; H01H 2085/0275; H01H 2085/0412; H01H 2085/0414;
(Continued)

(56) References Cited

U.S. PATENT DOCUMENTS 3,354,282 A 11/1967 Batsch
3,813,577 A * 5/1974 Kawiecke ..... H01T 1/14 337/32

(Continued)

FOREIGN PATENT DOCUMENTS

DE 3837458 A1 5/1990
DE 10226357 A1 1/2004

(Continued)

OTHER PUBLICATIONS

International Search Report dated Dec. 6, 2011 from corresponding PCT Application No. PCT/EP2011/062793.

*Primary Examiner* — Anatoly Vortman
*Assistant Examiner* — Jacob Crum
(74) *Attorney, Agent, or Firm* — Grogan, Tuccillo & Vanderleeden, LLP

(57) ABSTRACT

In order to provide a method for isolating a circuit and a thermal link, wherein the link has a very low resistance and is suitable for high currents, in particular very high short load currents, and also has a high degree of reliability, in particular under difficult conditions, such as thermal and mechanical loading which lasts for a relatively long time, for example, the invention proposes that, during the phase transition of the material of the fusible element (10) from the solid to the liquid state, the volume of the fusible element (10) increases and the pressure increases and, owing to the increase in volume and the increase in pressure, the fusible element (10) is dislodged so as to break the electrical connection.

18 Claims, 3 Drawing Sheets

(51) Int. Cl.

| | |
|---|---|
| ***H01H 37/76*** | (2006.01) |
| ***H01H 85/06*** | (2006.01) |
| ***H01H 85/12*** | (2006.01) |
| *H01H 85/041* | (2006.01) |
| *H01H 85/08* | (2006.01) |

(52) U.S. Cl.

CPC ..... *H01H 85/06* (2013.01); *H01H 85/12* (2013.01); *H01H 85/0411* (2013.01); *H01H 85/08* (2013.01); *H01H 2037/768* (2013.01); *H01H 2085/0412* (2013.01); *H01H 2085/0414* (2013.01)

(58) Field of Classification Search

CPC ..... H01H 85/0411; H01H 2037/768; H01H 85/046; H01H 85/06; H01H 85/08; H01H 85/11; H01H 85/12; H01H 37/761; B22D 41/015

USPC ..... 337/416, 160, 295–297

See application file for complete search history.

(56) References Cited

U.S. PATENT DOCUMENTS

| | | | | |
|---|---|---|---|---|
| 4,533,896 | A * | 8/1985 | Belopolsky | H01H 85/0411 219/253 |
| 5,572,181 | A * | 11/1996 | Kiryu et al. | 337/273 |
| 6,198,376 | B1 * | 3/2001 | Ishikawa et al. | 337/297 |
| 6,259,348 | B1 * | 7/2001 | Kuriyama | 337/252 |
| 2002/0097547 | A1 * | 7/2002 | Fukuoka et al. | 361/118 |
| 2008/0129440 | A1 * | 6/2008 | Ho | H01C 1/08 337/5 |
| 2008/0191832 | A1 | 8/2008 | Tsai | |
| 2009/0027821 | A1 * | 1/2009 | Colby | H01C 7/02 361/104 |
| 2010/0085141 | A1 * | 4/2010 | Knab et al. | 337/227 |

FOREIGN PATENT DOCUMENTS

| | | | |
|---|---|---|---|
| DE | 102005024346 | A1 | 11/2006 |
| DE | 102005058221 | B3 | 7/2007 |
| DE | 102007014334 | A1 | 10/2008 |
| JP | 2008169445 | A | 7/2008 |

* cited by examiner

THERMAL SAFETY DEVICE

DESCRIPTION

The invention concerns a method for purposes of disconnecting an electrical circuit. The invention furthermore concerns a thermal safety device for purposes of disconnecting an electrical circuit by the melting of a fusible element.

STATE OF THE ART

Thermal safety devices of the type indicated are increasingly gaining in significance, for example, in vehicles in the automotive industry, by virtue of the increasing use of semiconductor components (MOSFETs, IGBTs) for purposes of switching high currents in electrical loads. In the event of a fault in the semiconductor switching element e.g. as a result of a short circuit, or on account of a partial breakdown or another malfunction, the result can be an impermissible and possibly fatal increase in temperature by virtue of an erroneous current flow.

This is particularly the case in vehicles where certain loads such as e.g. cooling fans, ABS controllers, heating fans, power assisted steering, or even an electrical steering system, or similar, are not electrically connected via the ignition lock, but rather directly with the battery.

Such loads are not usually connected to the battery via the ignition lock since after the vehicle has been used, i.e. has been shut down, the possibility of ongoing operation or subsequent operation of the load must be ensured. For example, at a certain temperature it is necessary to allow the cooling fan to continue to run for a certain time after operation of the vehicle in order to avoid temperature peaks, and to achieve a reduction of the engine temperature.

Such a safety device functions as excess temperature protection, in that on attainment of a switching temperature, caused by a malfunction, in particular a short circuit of an electrical component, it interrupts the power supply and prevents any further rise in temperature that could be fatal under some circumstances.

In cases where there is no short circuit and in other circuits that are not directly connected with the battery, such a safety device also serves as excess temperature protection. If e.g. in the case of a partial breakdown of a switching element, only a slightly increased current flows into the load; this fault cannot be detected by a conventional over-current safety device. The temperature then continues to rise in the load, typically encapsulated, and under some circumstances this can even lead to a fire.

Further applications of the thermal safety device can in general provide excess temperature protection and fire protection for high power loads, for example for purposes of protecting solar cells, or heavy-duty battery cells, and also ancillary heating systems.

Thermal safety devices based on spring technology or melting wax technology are already state-of-the-art in items of household equipment, e.g. coffee machines. Such safety devices by virtue of their low current capacity cannot be used for power applications with high currents.

From the prior art thermal safety devices that are activated without any mechanical forces (e.g. springs) are of known art from U.S. Pat. No. 7,068,141 B2.

The mode of operation of these safety devices goes back to the wetting properties of the fusible element when it achieves the activation temperature. Activation takes place as a result of melting of the fusible element, which as a result of the wetting forces is drawn onto correspondingly large surfaces. Here the fusible element is surrounded by the accommodating surfaces of a casing whilst leaving free a buffer volume for the molten material of the element to flow out.

What is disadvantageous in such safety devices, which are normally used in consumer applications, e.g. mobile telephones, is the fact that they are not suitable for high currents since on account of the principle of activation only a small mass of the fusible element is available.

For the automotive sector there are proposals for circumventing the limitations cited above.

DE 244 375 A1 describes a thermal safety device in the form of a fusible resistance for deployment in power supplies and power circuits.

DE 10 2007 014 338 A1 describes a thermal safety device in the form of a circuit structure, in particular in the form of a stamped grid or a printed circuit board, which has a fusible element and effects the disconnection of the electrical connection by virtue of the surface tension.

DE 10 2008 003 659 A1 concerns a fusible safety device with a conductor bar, which in normal operation serves as an electrically conducting connection, and which melts in the event of a thermal fault on attainment of a certain temperature.

In DE 10 2007 014 339 A1, for example, a thermal safety device is described, which has a connecting element, and also a separately designed actuator. The actuator disconnects the electrical connection in a mechanical manner on attainment of a certain activation temperature.

Furthermore thermal safety devices are of known art that normally have a soldered-on leaf spring, which disconnects the electrical connection on attainment of a certain temperature.

What is disadvantageous in the said safety devices, amongst other features, is the fact that the solder and the connection points are permanently subjected to material stresses, and as a result the service life and reliability of the thermal safety device is limited, in particular under harsh ambient conditions with temperature-cycling loads.

PRESENTATION OF THE INVENTION

Problem, Solution, Advantages

The problem underlying the invention is that of providing a thermal safety device for purposes of disconnecting an electrical circuit, wherein the safety device has a very low resistance and is suitable for high currents, in particular for very high short-circuit currents, and also has a high reliability, in particular under difficult conditions such as e.g. thermal and mechanical loads that are of longer duration.

The said problem is solved by a thermal safety device in accordance with the features of the present invention.

The inventive thermal safety device is constructed as a fusible safety device, which executes the disconnection of an electrical circuit when activated by the melting of a fusible element. In order to ensure a reliable disconnection of an electrical circuit the thermal safety device has at least two electrically conductive terminals and also a fusible element, which melts on attainment of a certain temperature. The thermal safety device furthermore has an encapsulation or encasement. Here the fusible element is surrounded by a casing without provision of any free buffer volume between fusible element and casing, i.e. between components of the thermal safety device. A moulding material based on an epoxy resin could e.g. be deployed as the material for the encapsulation or encasement. In principle however it is also possible to use other materials and lacquering methods. The thermal safety device has furthermore a layered construction, wherein at least one additional coating, i.e. material layer, is provided between the terminals and the encapsulation or encasement.

With the use of the inventive thermal safety device an electrical circuit is disconnected on attainment of a certain temperature. Before attainment of the activation temperature, the thermal safety device represents an electrical conductor with a very high conductivity. Two electrically conductive terminals of the thermal safety device are hereby electrically connected with one another by means of a fusible element. The material of the fusible element is designed such that the melting temperature of the fusible element material is located in the range of the activation temperature desired for the safety device. On attainment of the melting temperature the fusible element begins to melt. During the phase change of the fusible element material from the solid state into the liquid state the volume of the fusible element increases. By virtue of the encapsulation of the fusible element in the thermal safety device a pressure rise occurs. The thermal safety device is hereby designed such that by virtue of the encapsulation of the fusible element no buffer volume is provided between the fusible element and the encasement for the purpose of accommodating the fluid fusible element material. Within the fusible safety device the fusible element is completely surrounded by directly adjoining components, e.g. the encasement, the terminals, or a coating applied onto the terminals, or other components of the thermal safety device. The fusible element is thus at no point surrounded by any free buffer volume. Moreover the fusible element is not in contact with any free buffer volume, wherein the buffer volume has air or another gaseous substance. Thus as a result of the pressure rise the fusible element is displaced such that the electrical connection between the terminals is disconnected.

The increase in volume during the phase change of the fusible element material from the solid state into the liquid state takes place extremely rapidly and in the form of a step change in volume. Thus by virtue of a sudden rise in volume a rapid pressure rise is enabled and by this means a reliable activation of the thermal safety device.

The fluid fusible element material flows out by virtue of the increase in volume and the pressure rise associated with it, and also by virtue of the capillary action. The capillary is hereby designed in the form of a coating on the terminals, which liquefies at a temperature in the range of the melting temperature of the fusible element material. During the switching operation the fusible element and coating mix together and flow out through the capillary volume by virtue of the pressure rise and the capillary action. The material that flows out of the fusible element and the coating thus collects at least partially in the outer region of the thermal safety device on the terminals. The outer region is the region of the thermal safety device that is not enclosed by an encasement.

The fusible element is preferably located in the thermal safety device such that it is in direct contact with the terminals, or in direct contact with a coating applied on the terminals. The encapsulation or encasement can preferably have an additional layer of lacquer on the inner face towards the fusible element.

Furthermore it is preferable for the thermal safety device to be able to have a flux similar to that which is used, e.g. for soldering. During the activation of the safety device deployment of a suitable flux promotes activation of the surface, and, on attainment of the melting temperature, the mixing together of fusible element and coating, and also the flowing out of the material through the capillary. When selecting the flux it is important to use a flux that is stable over the long term, which ensures activation even after being subjected to a higher temperature over a long period of time under operating conditions of typically 100 to 200° C. Even when using a flux no buffer volumes are provided adjacent to the fusible element and/or the flux.

The fusible element is preferably located between the two electrically conductive terminals. Thus the fusible element is arranged in a gap between the terminals. Here the fusible element can be in direct contact with the terminals, or in direct contact with a coating provided on the terminals. This has the advantage that during the activation operation, on attainment of a certain temperature the disconnection of the electrical circuit is executed by virtue of the interruption of the electrical connection between the two terminals.

Furthermore it is preferable for the coating forming the capillary to be formed by galvanisation of the two terminals. Zinc, indium, bismuth, silver, or an alloy consisting of zinc, indium, bismuth, or silver, is preferably selected as the material for the said coating. Such a coating promotes the accommodation of the fusible element on attainment of the melting temperature. Here the material layer between the terminals and the encapsulation or encasement, should preferably have a thickness between 1 μm and 50 μm, particularly preferably of between 5 μm and 20 μm.

In order to ensure good stability of the thermal safety device with age the coating of the terminals is preferably formed such that between the terminals and the encapsulation or encasement, the coating, e.g. the tin layer, has a nickel undercoat, wherein the nickel undercoat can consist of a layer of pure nickel, or of an alloy containing nickel. The said nickel undercoat is thus an additional layer between the terminals and the coating, e.g. the tin layer. Thus the nickel undercoat is in direct contact with the terminal and the coating, e.g. the tin layer. The nickel coating hereby serves as a barrier layer, and forms a diffusion barrier between the terminals consisting of e.g. copper, and the coating. Such a diffusion barrier prevents the formation of intermetallic phases. Thus it is also ensured that even after ageing a sufficiently thick coating is still present between the terminals and the encapsulation or encasement, e.g. a sufficiently thick layer of tin for purposes of accommodating the fusible element and activating the safety device. The layer of nickel, or of the alloy containing nickel, can hereby preferably have a thickness of between 1 μm and 50 μm, particularly preferably of between 5 μm and 15 μm.

The fusible element preferably consists of a conductive low melting point metal, or an alloy containing a low melting point metal, the composition of which is determined by the desired activation temperature. Conventional solder alloys, such as e.g. tin-silver solders, SnAgCu-solders, lead solders or other solder alloys can preferably be used. The following table shows examples of of possible compositions for the solder alloy as a function of the desired activation temperature for the thermal safety device.

TABLE 1

| Alloy composition | | Fluid phase point (° C.) |
|---|---|---|
| Bi:Sn:Pb = | 52.5:32.0:15.5 | 95 |
| Bi:Pb:Sn = | 55.5:44.0:1.0 | 120 |
| Pb:Bi:Sn = | 43.0:28.5:28.5 | 137 |
| Bi:Pb = | 55.5:44.5 | 124 |

TABLE 1-continued

| Alloy composition | | Fluid phase point (° C.) |
|---|---|---|
| Bi:Sn = | 58.0:42.0 | 138 |
| Sn:Pb = | 63.0:37.0 | 183 |
| Sn:Ag = | 97.5:2.5 | 226 |
| Sn:Ag = | 96.5:3.5 | 221 |
| Pb:In = | 81.0:19.0 | 280 |
| Zn:Al = | 95.0:5.0 | 282 |
| In:Sn = | 52.0:48.0 | 118 |
| Pb:Ag:Sn = | 97.5:1.5:1.0 | 309 |

Here the alloy compositions listed in the table are only examples of solder alloys. Other alloy compositions could also be used.

Furthermore one advantageous configuration of the invention envisages that the terminals have the form of caps. Here it is preferable for the caps to have a circular cross-section, or a cross-section similar to that of a circle, and also to have internally a cavity, at least in certain regions.

In a similar manner it is furthermore preferable for the terminals to have the form of a cuboid, or a form similar to that of a cuboid. Here the terminals form the base body of the thermal safety device. This has the advantage that the thermal safety device can be designed as a surface mounted device (SMD) in the form of a flat safety device.

Other or further geometric configurations of the inventive thermal safety device are also possible.

It is also preferable for the electrically conductive terminals to accommodate at least one non-conductive body. In principle each of the two terminals could accommodate in each case one or a plurality of non-conductive bodies. The one or more non-conductive bodies hereby possess e.g. the form of the caps, such that after assembly they fill the interior free space of the caps. The one or more non-conductive bodies hereby hold the electrically conductive terminals, e.g. caps, in position. Furthermore this has the advantage that the fusible element can be positioned and held by the insulating bodies in a suitable position between the electrically conductive terminals. Furthermore the one or more non-conductive bodies could have the form of a cuboid, or a form similar to that of a cuboid, wherein the one or more non-conductive bodies serve to support or hold the electrically conductive terminals.

In a similar manner it is further preferable for the one or more non-conductive bodies, independently of the geometric configuration, to consist of a ceramic, e.g. $Al_2O_3$. In principle the non-conductive bodies could also consist of another insulating material, e.g. glass, plastic, or another organic material.

It is also preferable for the fusible element to have the form of a ring. The diameter of such a ring could be selected so as to correspond with the diameter of the caps, but this is not necessarily the case. The deployment of a ring-shaped fusible element has the advantage that it can be held in a simple manner between the two electrically conductive caps by the non-conductive bodies, e.g. ceramic bodies. In a similar manner the ring could run around the non-conductive bodies externally. Furthermore the fusible element could be embodied in the form of one or a plurality of longitudinal strips with a certain protrusion between two cuboid-shaped terminals. The fusible element is thus arranged between the cuboid-shaped or cap-shaped electrical terminals, at least in certain regions. Furthermore the fusible element can in addition be arranged on the cuboid-shaped or cap-shaped electrical terminals, at least in certain regions.

Furthermore one advantageous configuration of the invention envisages the equipment of the thermal safety device with suitable electrical terminal connections, in that a wire, or an electrical conductor in a form similar to that of a wire, is connected to each of the two terminals, preferably centrally. Thus it is possible to deploy the thermal safety device in conventional devices or entrenchments without having to undertake structural alterations to the electrical load or to the device. Furthermore the electrical terminal connections can be configured in the form of a surface mounted device (SMD). Such an SMD component finds deployment in electronics as a component that can be surface mounted, or as a component for surface mounting. Furthermore forms of terminal connection for other types of mountings, e.g. using through hole technology, can also be conceived.

In order to ensure a high level of mechanical protection, a high level of mechanical stability, and also protection of the thermal safety device from oxidation, it is preferable to protect the thermal safety device by means of encapsulation or encasement. For purposes of improving these properties the encapsulation or encasement can also be combined with a further protective lacquer coating.

BRIEF DESCRIPTION OF THE FIGURES

The invention is now elucidated in an exemplary manner with reference to the accompanying drawings with the aid of preferred forms of embodiment. In a purely schematic representation.

PREFERRED FORM OF EMBODIMENT OF THE INVENTION

Figure 1:
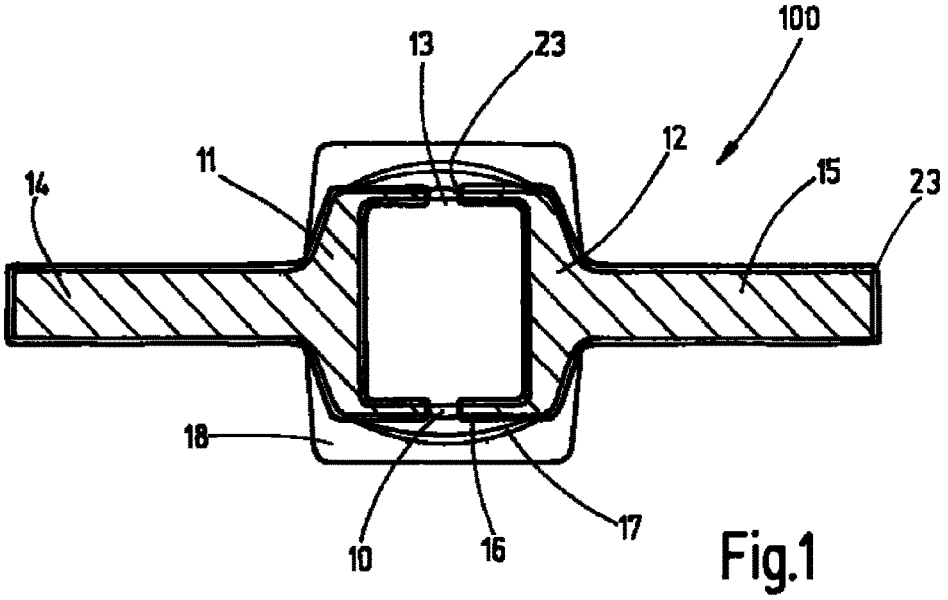
FIG. 1 shows a schematic representation of the inventive thermal safety device (100)

FIG. 1 shows a schematic representation of an inventive thermal safety device 100. The inventive thermal safety device 100 consists of two caps 11 and 12 with a centrally connected wire 14 and 15, a ceramic body 13, and also a fusible element 10. In order to ensure a very good electrical conductivity the two caps 11, 12 consist of copper. Alternatively the caps 11, 12 can also consist of another material with a low specific resistance. The caps 11, 12 and the wires 14, 15 are covered with a coating 23, preferably of a layer of tin. The coating could also contain another material, e.g. indium, bismuth, or silver, or an alloy consisting of tin, indium, bismuth or silver. A fusible element 10 is arranged between the two caps 11, 12; this is held by means of a ceramic body 13. The fusible element 10 has the form of a ring, and consists of a tin-silver alloy (e.g. Sn97 Ag3, with a melting point of 217° C.). The alloy could also have another composition with a lower or a higher melting point depending upon the activation temperature required for the safety device. On the fusible element 10 is located a flux 16 with long-term stability, which during the activation of the safety device serves to activate the surface and to reduce the surface tension. The encapsulation or encasement of the safety device, here consisting of a lacquer 17 that can be UV-hardened, and a moulding material 18 manufactured on the basis of an epoxy resin, serves to increase the mechanical stability of the safety device. Moreover the encapsulation or encasement 17, 18 offers both mechanical and oxidation protection. The encasement 18 only encloses the thermal safety device in certain regions. In particular the encasement 18 encloses the thermal safety device in the region in which the fusible element 10 is arranged. The ends of the caps 11, 12, in particular in the region of the terminal connection points, e.g. for the wires 14, 15, are hereby not enclosed by the encasement 18.

Figure 2:
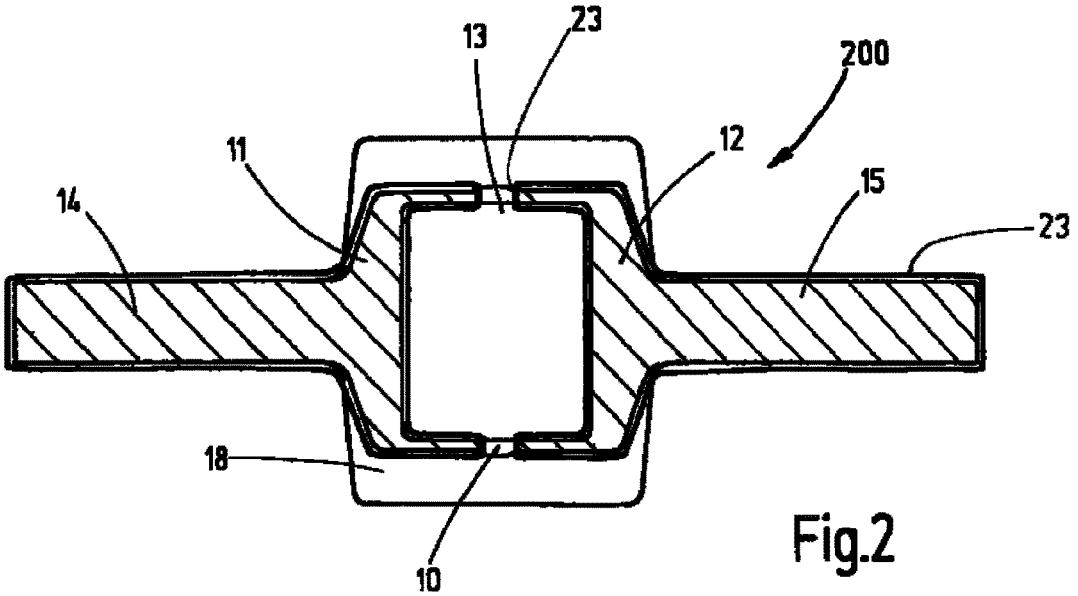
FIG. 2 shows a schematic representation of the inventive thermal safety device (200)

FIG. 2 shows a schematic representation of an inventive thermal safety device 200. The thermal safety device 200 consists essentially of the components of the thermal safety device 100 described in FIG. 1. A significant difference from the structure described in FIG. 1 is reflected in the fact that the thermal safety device 200 in FIG. 2 does not have any application of flux on the fusible element 10.

Figure 3:
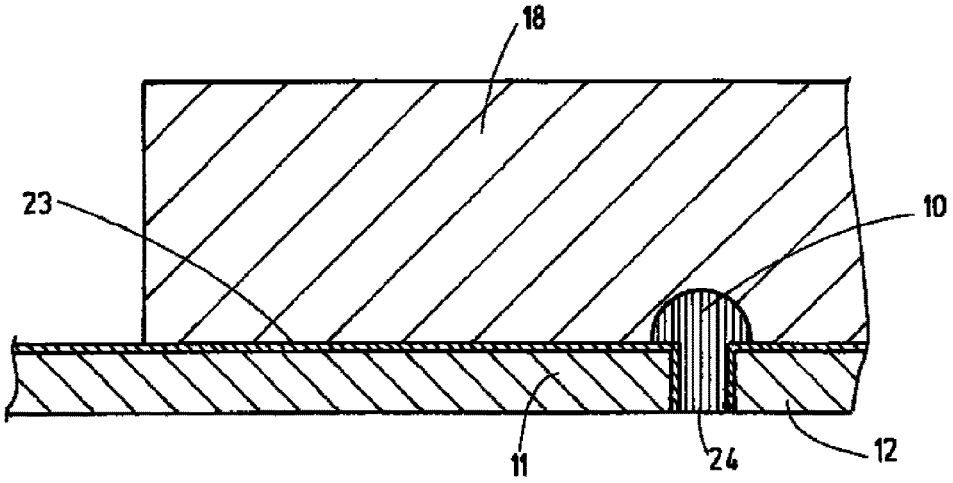
FIG. 3 shows a schematic representation of the switching principle of the inventive thermal safety device (100, 200, 300) before it is activated.
Figure 4:
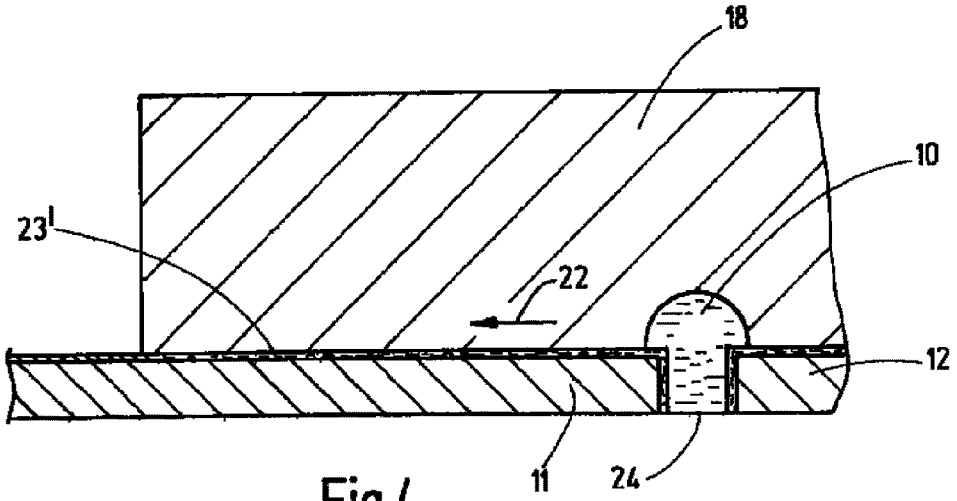
FIG. 4 shows a schematic representation of the switching principle of the inventive thermal safety device (100, 200, 300) on attainment of the melting temperature.
Figure 5:
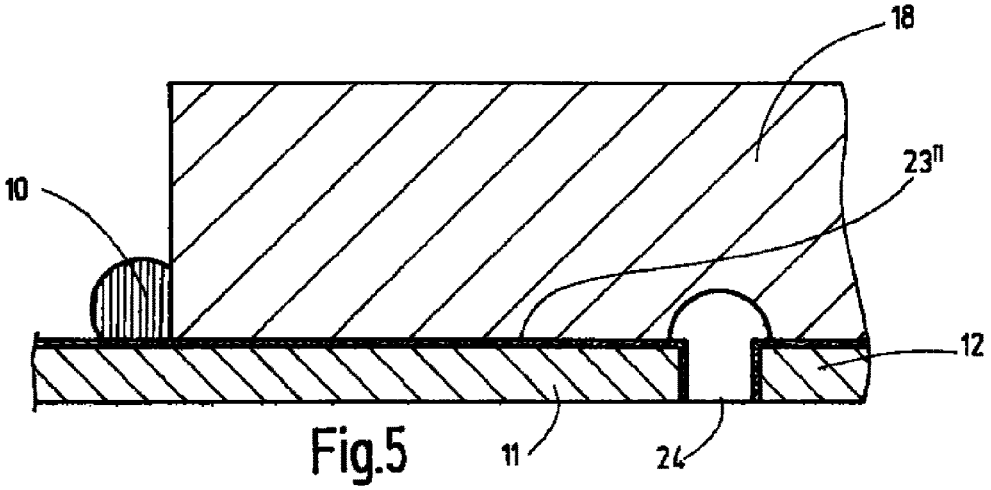
FIG. 5 shows a schematic representation of the switching principle of the inventive thermal safety device (100, 200, 300) after the activation operation.

FIGS. 3 to 5 show schematic representations of the switching principle of the inventive thermal safety device 100, 200, 300 before attainment of the melting temperature, on attainment of the melting temperature, and also after attainment of the melting temperature.

FIG. 3 shows the state before the activation of the inventive thermal safety device 100, 200, 300, i.e. before attainment of the melting temperature. Before attainment of the melting temperature the fusible element 10 is located in a solid state in the gap 24 between the terminals 11, 12 with the coating 23 and the encapsulation or encasement 18. For the activation of the thermal safety device 100, 200, 300 the pressure gradient as a result of a volume increase on the one hand, and also a step change in volume during the transition from the solid into the fluid phase, is of particular significance, as is the capillary action.

FIG. 4 shows the state of the inventive thermal safety device 100, 200, 300 on attainment of the melting temperature. On attainment of the melting temperature the fusible element 10 starts to melt. As the fusible element melts the coating 23' in the region of the encapsulation or encasement also melts, as a result of which the fusible element 10 and coating 23' mix together at least partially. The displacement into and through the capillary is essentially caused by the pressure rise during the phase change of the fusible element 10 from a solid to a fluid, and the step change in volume that accompanies this. FIGS. 4 and 5 show the migration of the fusible element 10 as it melts and after the activation. To visualise the process more clearly the flow direction 22 of the fusible element during migration is shown in FIG. 4. Here it should be noted that the fusible element 10 migrates completely out of the gap 24.

FIG. 5 shows the switched state of the thermal safety device 100, 200, 300 after the activation operation and the complete migration of the fusible element 10 out of the gap 24. After the activation operation is complete the coating 23" that is mixed together with the fusible element solidifies and deposits itself on the terminals, i.e. in the original location of the coating 23 before attainment of the melting temperature. After completion of the activation operation and the outflow of the fusible element 10 the current flow through the thermal safety device 100, 200, 300 is interrupted by the interruption at the gap between the two terminals 11, 12 or base bodies 19.

Figure 6:
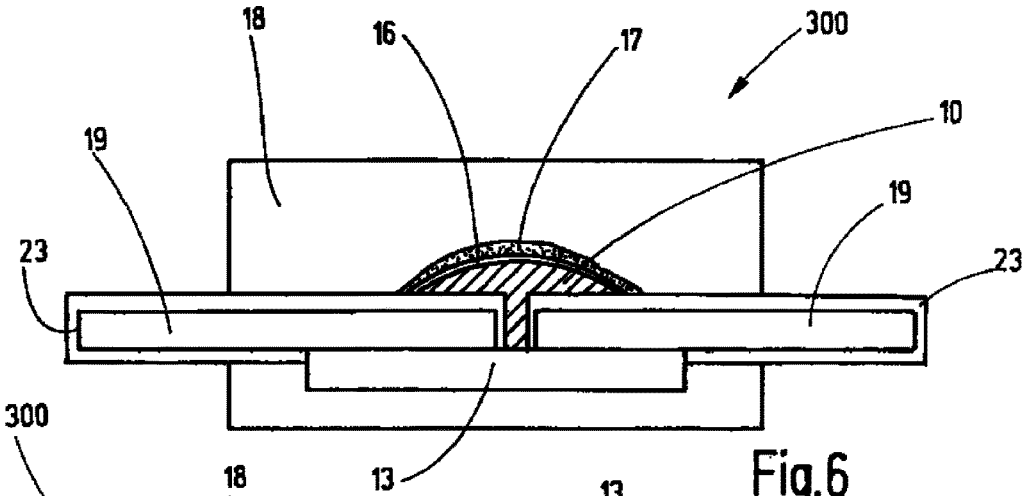
FIG. 6 shows a schematic representation of the inventive thermal safety device (300)
Figure 7:
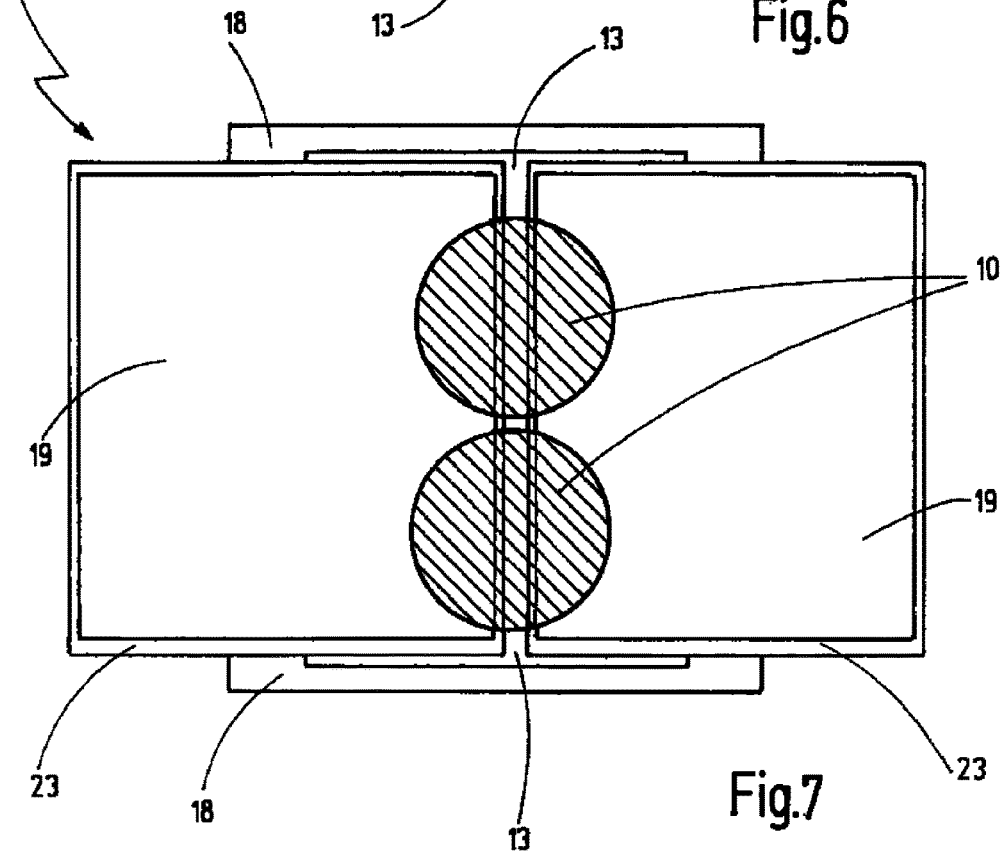
FIG. 7 shows a further schematic representation of the inventive thermal safety device (300).

FIGS. 6 and 7 show schematic representations of an inventive thermal safety device 300. The inventive thermal safety device 300 is designed as a flat safety device for surface mounting. The inventive thermal safety device 300 includes two cuboid terminals 19 spaced apart from one another, which are applied on a non-conductive body 13, e.g. a ceramic body. In order to ensure a very good electrical conductivity the two base bodies 19 (terminals) consist of copper, or another material with a low specific resistance. The two base bodies 19 (terminals) are covered with a coating 23, preferably as a layer of tin. The coating could also contain another material, e.g. indium, bismuth, silver, or an alloy consisting of tin, indium, bismuth or silver. Furthermore the thermal safety device 300 has a fusible element 10 between the two base bodies 19 (terminals) and also in the region around the buffer space (gap 24) between the two base bodies 19 (terminals). As shown in FIG. 6, the thermal safety device 300 has two fusible elements 10. The safety device could however also have one, or more than two, fusible elements 10. On the fusible element 10 is located a flux 16 with long-term stability, which during the activation of the safety device serves to activate the surface and to reduce the surface tension. An additional layer of lacquer 17 is located between the encapsulation or encasement 18 of the safety device and the flux. The encapsulation or encasement 18 can only be applied on the upper face of the thermal safety device. The encapsulation or encasement 18 and also the additional paint layer 17 serve to increase the stability of the safety device and also its oxidation protection. The layer of lacquer 17 is in direct contact with the flux 16 without leaving free any buffer space. The thermal safety device 300 could also be designed such that it has no flux 16 on the fusible element 10. In this case the layer of lacquer 17, or, in the event that no additional layer of lacquer 17 is present, the encapsulation 18, would be in direct contact with the fusible element 10 without leaving free any buffer volume.

REFERENCE SYMBOLS

100 Thermal safety device
200 Thermal safety device
300 Thermal safety device
10 Fusible element
11, 12 Terminals/caps
13 Electrically non-conductive body
14, 15 Wire
16 Flux
17 Lacquer covering/lacquer encasement
18 Encasement/encapsulation
19 Base body
22 Flow direction
23 Coating/layer of tin
23' Coating (melted)
23" Coating/(solidified layer of tin with melted solder material)
24 Gap

The invention claimed is:

1. A thermal safety device, which executes the disconnection of an electrical circuit by the melting of a fusible element, the thermal safety device comprising:

at least two electrically conductive terminals;

a fusible element located in a gap between the at least two electrically conductive terminals creating an electrical circuit therebetween;

an encasement spanning the gap between the terminals, a coating located between the encasement and at least one of the terminals and being in direct contact with the at least one of the terminals on one side and with the encasement on the opposite side, the coating liquefying at a temperature in the range of a melting temperature of the fusible element; and wherein the melting temperature of the coating is equal or higher than the melting temperature of the fusible element;

wherein the fusible element is completely encapsulated by at least the encasement, the coating and the terminals when the coating is in a solid state;

wherein when the coating is in the solid state, the coating blocks the melted fusible element such that the melted fusible element cannot flow out of the thermal safety device; and wherein when the coating liquefies, a capillary is formed in a space previously occupied by the coating in the solid state which allows the melted fusible element to flow from the gap between the terminals and out from the thermal safety device to disconnect the electrical circuit.

2. The thermal safety device in accordance with claim 1, characterised in that, the fusible element is in direct contact with the terminals and the encasement.

3. The thermal safety device in accordance with claims 1, characterised in that, the encasement has a layer of lacquer on the inner face towards the fusible element.

4. The thermal safety device in accordance with claim 1, characterised in that, the thermal safety device has a flux.

5. The thermal safety device in accordance with claim 1, characterised in that, the fusible element is located between the two terminals.

6. The thermal safety device in accordance with claim 1, characterised in that, the coating between the terminals and the encasement contains tin, indium, bismuth, or an alloy of tin, indium, or bismuth.

7. The thermal safety device in accordance with claims 1, characterised in that, the coating between the terminals and the encasement has a thickness of between 1 μm and 50 μm.

8. The thermal safety device in accordance with claim 1, characterised in that, the fusible element comprises a low melting point metal, an alloy containing a low melting point metal, or a lead solder.

9. The thermal safety device in accordance with claim 1, characterised in that, the fusible element comprises a tin-silver alloy.

10. The thermal safety device in accordance with claim 1, characterised in that, the terminals have the form of caps.

11. The thermal safety device in accordance with claim 1, characterised in that, the terminals have the form of a cuboid, or a form similar to that of a cuboid.

12. The thermal safety device in accordance with claim 1, characterised in that, the thermal safety device has at least one electrically non-conductive body, wherein the said at least one electrically non-conductive body serves to hold the terminals.

13. The thermal safety device in accordance with claim 12, characterised in that, the at least one electrically non-conductive body comprises ceramic, glass, plastic, or another organic material.

14. The thermal safety device in accordance with claim 1, characterised in that, the fusible element has the form of a ring.

15. The thermal safety device in accordance with claim 1, characterised in that, an electrical conductor is connected to each of the terminals.

16. The thermal safety device in accordance with claim 15, characterised in that, the electrical conductor has the form of a wire, or a form that is similar to that of a wire.

17. The thermal safety device in accordance with claim 1, characterised in that, the thermal safety device has a lacquer covering, or a lacquer encasement.

18. An application of a thermal safety device in accordance with claim 1 as a fusible safety device, for purposes of protecting solar cells, high energy battery cells, ancillary heating systems, electrical loads, in particular in vehicles, and also for purposes of protection from excess temperature, and fire protection.

* * * * *